US005139444A

United States Patent [19]

Garay et al.

[11] Patent Number: 5,139,444

[45] Date of Patent: Aug. 18, 1992

[54] INSULATING JACK PLUG AND METHOD FOR MAKING

[75] Inventors: Antonio A. Garay, Roselle; Robert J. Tait, Arlington Heights, both of Ill.

[73] Assignee: Raytheon Company, Lexington, Mass.

[21] Appl. No.: 761,112

[22] Filed: Sep. 17, 1991

[51] Int. Cl.[5] ..... H01R 13/00

[52] U.S. Cl. ..... 439/668

[58] Field of Search ..... 439/668, 669, 703-708

[56] References Cited

U.S. PATENT DOCUMENTS 657,399 9/1900 Dean ..... 439/668

*Primary Examiner*—Joseph H. McGlynn

*Attorney, Agent, or Firm*—Judith A. Caplan; Richard M. Sharkansky

[57] ABSTRACT

An electrical jack plug includes an insulating sleeve member disposed over the conductor and ground contact portions of a tip contact member. The sleeve member includes a thin conductive outer sleeve member and an insulating plastic inner sleeve member press fit inside the outer sleeve member. The inner sleeve member has a portion, disposed on the interior thereof, adapted to mate with a complimentary portion of a tip contact member. In assembly, the conductor and ground contacting portions of the tip contact member are surrounded by the insulating inner sleeve member to prevent shorting of such connections. The insulating inner sleeve member has an annular portion extending beyond the conductive outer sleeve member. The inner sleeve member may be comprised of colored plastic to provide a readily visible color coding scheme for interconnections provided by the electrical jack plug.

10 Claims, 2 Drawing Sheets

INSULATING JACK PLUG AND METHOD FOR MAKING

BACKGROUND OF THE INVENTION

This invention relates generally to electrical jack connectors and more particularly to an electrical jack plug having an insulating sleeve member.

As is known in the art, an electrical jack plug may be of the type having a spear-like tip contact member with a tapered tip component and a rod member extending axially from the tip tapered component. The rod member is insulated from the tapered tip component and is coupled to a ground contact member disposed in axial relationship with such rod member. The tapered tip component is coupled to a conductor contact member disposed adjacent to the ground contact member and insulated therefrom. More particularly, the conductor contact member and the ground contact member are disposed at an end of the tip contact member distal from the tapered tip component. Disposed between the tapered tip component and such distal end of the tip contact member is a mating portion which, in assembly, is mated with and covered by a sleeve member. A coaxial or other suitable cable is routed through the sleeve member for connection with the conductor and ground contact members. More particularly, a center conductor of the coaxial cable is coupled to the conductor contact member and the outer ground conductor, or braid, of the coaxial cable is coupled to the ground contact member.

As is also known in the art, the sleeve member is generally comprised of solid brass which is machined to provide screw threads on an inner portion thereof. The screw threads thus provided mate with the mating portion of the tip contact member. Brass is a desirable material for the sleeve member due to its strength and rigidity. However, in order to insure that the center conductor of the coaxial cable does not contact the ground braid of the coaxial cable by simultaneous contact with the conductive brass sleeve member, an insulating sheath is generally provided. More particularly, a hollow plastic sheath is disposed around the distal end portion of the tip contact member where the center conductor of the coaxial cable is attached to the conductor contact member and the ground braid thereof is attached to the ground contact member. In this way, simultaneous contact of the center conductor and the ground braid of the coaxial cable with the conductive sleeve member is avoided.

SUMMARY OF THE INVENTION

It is an object of the present invention to provide an inexpensive electrical jack plug.

It is also an object of the present invention to provide an electrical jack plug having relatively simple manufacturability.

An additional object is to provide an electrical jack plug having a color coding feature.

A still further object is to provide an electrical jack plug with an inexpensive color coding feature.

These and other objects of the present invention are attained generally by providing an electrical jack plug having a tip contact member and a sleeve member assembly. More particularly, the tip contact member has a first end with a tapered tip component adapted for coupling to a jack receptacle, a second end with a conductor contact member, and a mating portion disposed axially between the first and second ends The sleeve member assembly is disposed over the second end of the tip contact member and includes an insulating inner sleeve member and a conductive outer sleeve member. The insulating inner sleeve member has a portion mated with the mating portion of the tip contact member. The conductive outer sleeve member is coupled to and substantially surrounds the insulating inner sleeve member.

With this arrangement, the cost of the sleeve member assembly is greatly reduced as compared to the prior art brass sleeve member. More particularly, two functions of the prior art brass sleeve member (i.e. providing structural rigidity to the sleeve member and providing a portion for mating to the tip contact member) are provided by the plastic inner sleeve member. Since the plastic inner sleeve member is relatively inexpensive to manufacture by plastic molding, as compared to several machining steps required to provide the conventional brass sleeve member, a significant cost savings is realized. Additional cost savings are attained by using a relatively inexpensive zinc alloy material for the conductive outer sleeve member, as opposed to the brass of the prior art sleeve member.

In accordance with a further aspect of the present invention, the sleeve member assembly has an end disposed proximal to the tapered tip component and an end disposed distal from the tapered tip component and the insulating inner sleeve member has an annular portion protruding beyond the outer sleeve member at the proximal end. With this arrangement, a color coding feature is provided. More particularly, the protruding annular portion of the insulating inner sleeve member may be provided in various colors and is readily visible in order to provide a color coding scheme.

In accordance with an alternate embodiment of the present invention, the insulating inner sleeve member has an annular portion protruding beyond the outer sleeve member at the distal end. Such an arrangement also provides a color coding feature since the insulating inner sleeve member may be provided in various colors and the protruding annular portion of the insulating inner sleeve member is readily visible.

In accordance with a further feature of the present invention, a method for providing an insulating jack plug is provided. The method comprises the step of providing a tip contact member having a first end with a tapered tip component adapted for coupling to a jack receptacle, a second end with a conductor contact member, and a mating portion disposed axially between the first and second ends. A sleeve member assembly having an insulating inner sleeve member with a mating portion and a conductive outer sleeve member is provided. The method further comprises the step of mating the mating portion of the tip contact member with the mating portion of said insulating inner sleeve member.

With this method, a relatively inexpensive insulating jack plug is provided. More particularly, the conventionally brass sleeve member is provided by an assembly of a plastic inner sleeve member and a zinc alloy outer sleeve member. The plastic inner sleeve member includes a portion for mating with a complimentary mating portion of the tip contact member. Additionally, the plastic inner sleeve member provides the sleeve member assembly with suitable structural rigidity.

BRIEF DESCRIPTION OF THE DRAWINGS

The foregoing features of this invention, as well as the invention itself, may be more fully understood from the following detailed description of the drawings in which.

DESCRIPTION OF THE PREFERRED EMBODIMENTS

Figure 1:
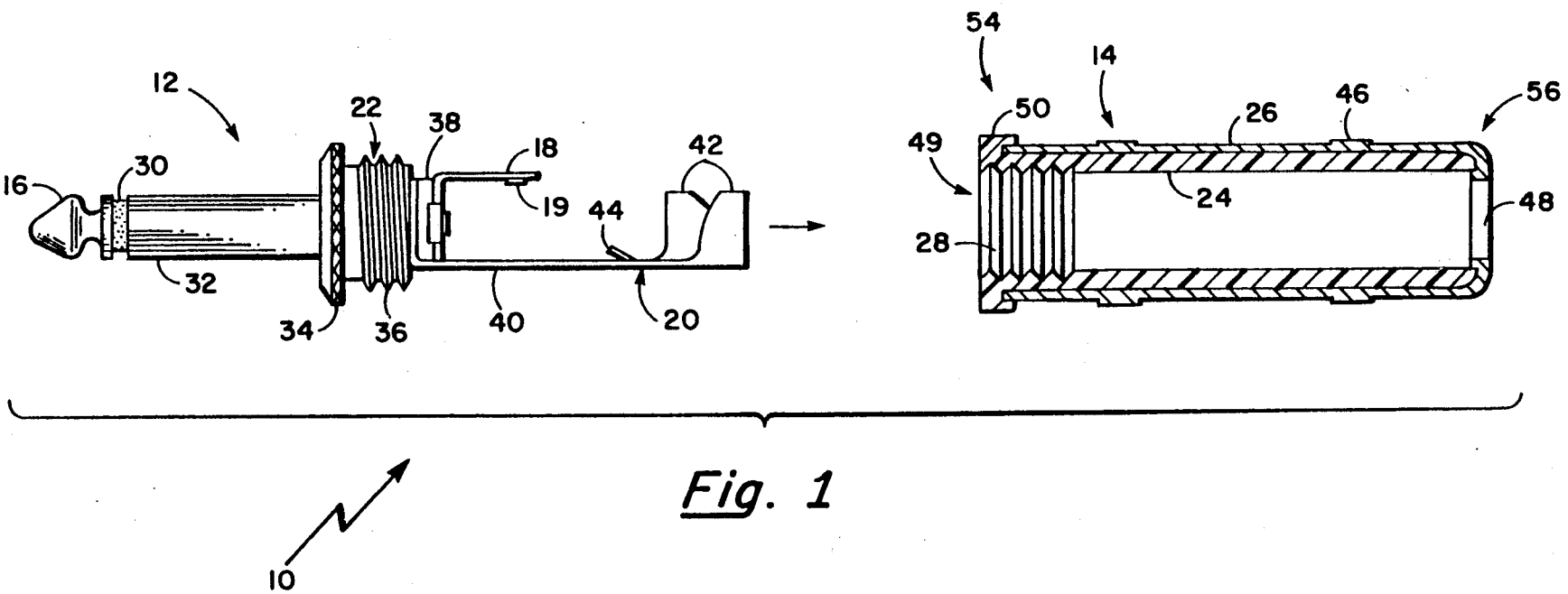
FIG. 1 is an exploded, partially sectioned view of an electrical jack plug having a sleeve member assembly in accordance with the present invention.

Referring now to FIG. 1, an electrical jack plug 10 is shown to include a tip contact member 12 and a sleeve member assembly 14. Tip contact member 12 has a tapered tip component 16 disposed at a first end thereof. Disposed at a second, distal end of tip contact member 12 is a conductor contact member 18 and a ground contact member 20, as shown. Tip contact member 12 further includes a mating portion 22 disposed axially between tapered tip component 16 and the conductor and ground contact members 18 and 20, respectively. Sleeve member assembly 14 has an insulating inner sleeve member 24 and a conductive outer sleeve member 26 disposed in surrounding, external contact therewith. More particularly, insulating inner sleeve member 24 has a mating portion 28 adapted for mating with the mating portion 22 of tip contact member 12.

Referring now specifically to tip contact member 12, the tapered tip component 16 thereof, is compatible with a conventional jack receptacle so that an instrument, such as a guitar for example, may be connected to an electrical device such as an audio amplifier. An insulating ring 30 is disposed between the tapered tip component 16 and an axially extending rod member 32. A knurled flange 34 is disposed adjacent rod member 32 at an end thereof distal from tapered tip component 16. Mating portion 22 is disposed adjacent to knurled flange 34, as shown, and here, comprises a plurality of screw threads 36. Conductor contact member 18 is disposed in axial relationship with rod member 32 and is insulated therefrom by an insulating disc 38. A conductor receiving aperture 19 is disposed through conductor contact member 18, as shown. Ground contact member 20 has an elongated portion 40 disposed parallel to conductor contact member 18 and coupled to mating portion 22. Elongated portion 40 has a protruding portion 44 extending obliquely therefrom, as shown. Ground contact member 20 further includes conductor receiving arms 42 disposed orthogonally to elongated portion 40.

Figure 2:
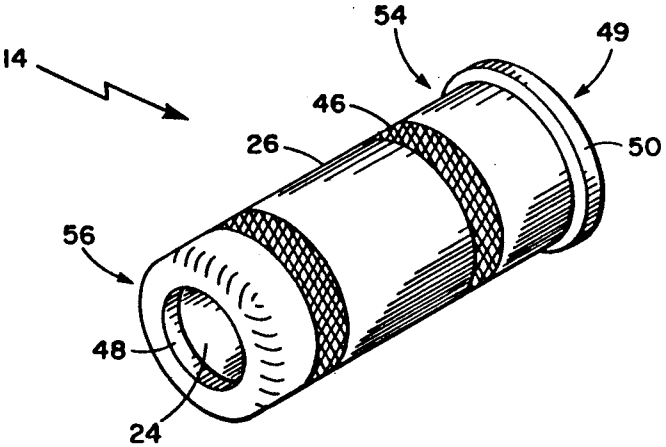
FIG. 2 is an isometric view of the sleeve member assembly of the electrical jack plug of FIG. 1.

Referring now generally to FIGS. 1 and 2, and more particularly to sleeve member assembly 14, conductive outer sleeve member 26 of sleeve member assembly 14 here, has a generally cylindrical shape, an outer diameter of approximately 0.525 inches, and an inner diameter of approximately 0.500 inches. Here, conductive outer sleeve member 26 is comprised of a zinc alloy having a thickness of approximately 0.0125 thickness. Disposed on the outer surface of conductive outer sleeve member 26 is here, a pair, of knurled annular grips 46. Such grips 46 facilitate turning sleeve member assembly 14 to mate with tip contact member 12, as will be described. Conductive outer sleeve member 26 has a bent, or curled portion 48 at an end 56 of sleeve member assembly 14 disposed distal from tapered tip component 16. Curled portion 48 of outer sleeve member 26 is bent over, as shown, in order to eliminate a potentially sharp edge of outer sleeve member 26 which may be detrimental to a coaxial, or any suitable cable (not shown) routed therethrough, as will be described.

Conductive outer sleeve member 26 is formed by punching or stamping a disc of flat zinc alloy stock from a sheet of suitable thickness. The stamped disc is then formed into outer sleeve member 26 by a conventional drawing technique. More particularly, the disc is disposed over a hollow cylindrical aperture and a cylindrical mandrel is lowered over the center of such disc. The outer sleeve member 26 is formed during a sequence of such drawing steps and here, approximately twelve of such steps. During one of the drawing steps, a knurled tool is pressed against the cylinder to provide the knurled annular grips 46. Also, during one of the drawing steps, end 56 of outer sleeve member 26 disposed distal from the tapered tip component 16 is bent over to provide the curled portion 48 thereof. During another step, excess zinc material (not shown) is removed to provide an aperture 49 at an end 54 of sleeve member assembly 14 proximal to tapered tip component 16. The cylinder thus formed is then nickel plated by a conventional electroplating technique to provide conductive outer sleeve member 26.

Insulating inner sleeve member 24 is, here, comprised of molded plastic. The outer diameter of inner sleeve member 24 is approximately 0.500 inches, and the inner diameter thereof is approximately 0.397 inches. More particularly, the outer diameter of inner sleeve member 24 is slightly larger, for example 0.502, at end 54 and slightly smaller, for example 0.475, at end 56. The draft, or taper thus provided in the inner sleeve member 24 facilitates manufacturability. In assembly, inner sleeve member 24 is press fit into outer sleeve member 26. The diameter of inner sleeve member 24 relative to that of outer sleeve member 26 insures that once press fit into outer sleeve member 26, inner sleeve member 24 will not slip out nor will such sleeve member 24 rotate relative to outer sleeve member 26. Moreover, the plastic inner sleeve member 24, once press fit inside outer sleeve member 26, provides suitable mechanical strength and rigidity to such outer sleeve member 26. As mentioned above, inner sleeve member 24 has a mating portion 28 complimentary to mating portion 22 of tip contact member 12 and adapted for mating therewith. Inner sleeve member 24 further has an annular portion 50 disposed at end 54 thereof and protruding beyond outer sleeve member 26. Here, annular portion 50 is diametrically larger in size than the outer sleeve member 26, as shown.

In assembly, a coaxial or other suitable cable (not shown) is passed through sleeve member assembly 14 for coupling to tip contact member 12 prior to such assembly 14 being mated with tip contact member 12, as will be described. More particularly, an end of the coaxial cable to be coupled to tip contact member 12 is stripped of insulation to expose the center conductor thereof and is passed through sleeve member assembly 14 from end 56 to end 54 thereof. The coaxial cable is routed through conductor receiving arms 42 and the center conductor thereof is suitably coupled to conductor contact member 18, such as by soldering. For example, the center conductor of the coaxial cable may be passed through the conductor receiving aperture 19 disposed through conductor contact member 18 and soldered thereto. Alternatively, such center conductor may be soldered directly to the conductor contact member 18. Conductor receiving arms 42 are crimped around the coaxial cable to provide strain relief to such cable. Moreover, such crimping operation may cause protruding portion 44 of ground contact member 20 to penetrate the exterior insulation of the coaxial cable and thus, to contact the ground braid of such cable. Note, however, that alternative ways of attaching the ground braid of the coaxial cable to the ground contact member 20 may be used. For example, a portion of the ground braid may be twisted, passed through an aperture (not labelled) disposed through elongated portion 40 under protruding portion 44, and soldered to elongated portion 40, as is conventional.

In further assembly, sleeve ember assembly 14 is disposed over the end of tip contact member 12 distal from tapered tip component 16 such that portion 28 of inner sleeve member 24 mates with complimentary mating portion 22 of tip contact member 12. More particularly, sleeve member assembly 14 is twisted, or screwed onto tip contact member 12 such that the knurled flange 34 of the tip contact member 12 contacts the annular portion 50 of the sleeve member assembly 14. Thus, when electrical jack plug 10 is assembled, annular portion 50 is readily visible. The plastic molded to form inner sleeve member 24 may be dyed to any desired color to provide a color coding scheme. More particularly, color coding of various electrical connections to an instrument may be provided by utilizing a plurality of electrical jack plugs 10 having respective annular portion 50 of different colors.

Figure 3:
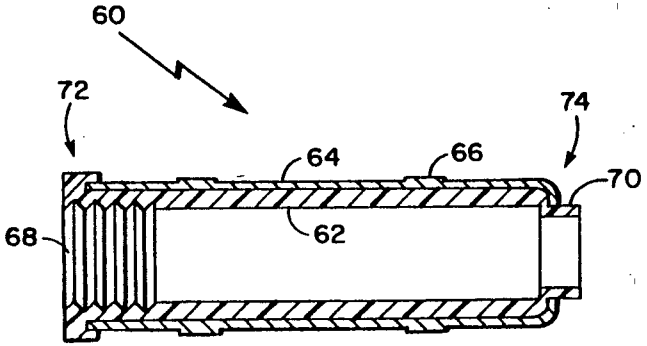
FIG. 3 is a sectioned view of a sleeve member assembly of an electrical jack plug in accordance with a further embodiment of the present invention.

Referring now to FIG. 3, an alternate embodiment of the present invention is shown. A sleeve member assembly 60 includes an insulating inner sleeve member 62 and a conductive outer sleeve member 64. Sleeve ember assembly 60 is adapted for mating with the tip contact member 12 of FIG. 1. Conductive outer sleeve member 64 has knurled annular grips 66 and is comprised of a zinc alloy. Here, conductive outer sleeve member 64 is identical to conductive outer sleeve member 26, described above in conjunction with FIGS. 1 and 2. Sleeve member assembly 60 further includes insulating inner sleeve member 62, here formed by molded plastic, as described above in conjunction with inner sleeve member 24. Further, like inner sleeve member 24 described above, sleeve member 62 has a mating portion 68 molded to provide screw threads. In assembly, screw thread portion 68, being disposed at an end 72 of sleeve member assembly 60 proximal to tapered tip component 16, mates with complimentary mating portion 22 of tip contact member 12 (FIG. 1).

Disposed at an end 74 of sleeve member assembly 60 distal from tapered tip component 16, is a protruding annular portion 70 of insulating inner sleeve member 62, as shown. Annular portion 70 axially protrudes beyond outer sleeve member 64 and is thus readily visible. As mentioned above in conjunction with insulating inner sleeve member 24, the plastic molded to form insulating inner sleeve member 62 may be provided in various colors. In this way, the protruding annular portion 70 of sleeve member assembly 60 provides a convenient color coding scheme to identify connections made with the use of sleeve member assembly 60.

Figure 4:
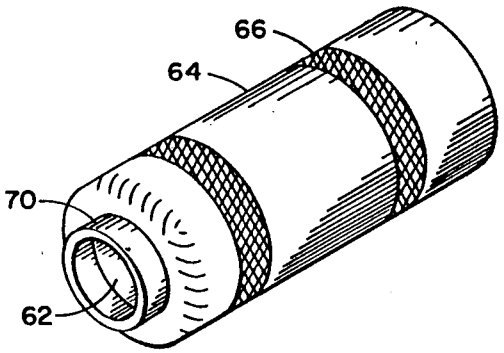
FIG. 4 is an isometric view of the sleeve member assembly of FIG. 3.

Referring now to FIG. 4, an isometric view of the sleeve member assembly 60 of FIG. 3 is shown. Conductive outer sleeve member 64 is shown to include knurled annular grips 66. Also shown, protruding axially beyond conductive outer sleeve member 64, is annular portion 70 of insulating inner sleeve member 62. It is thus apparent that annular portion 70 is readily visible and coloring thereof provides a convenient color coding scheme.

With the arrangements described above in conjunction with FIGS. 1–4, a relatively inexpensive electrical jack plug is provided. More particularly, alternative sleeve member assemblies 14 and 60 are comprised of relatively inexpensive materials and are relatively simple to manufacture. The conductive outer sleeve members 26 and 64 are comprised of an inexpensive zinc alloy which is electroplated with a thin layer of nickel. Furthermore, a relatively small amount of zinc alloy is required to form the thin conductive outer sleeve embers 26 and 64. Moreover, the zinc alloy is formed into conductive outer sleeve members 26 and 64 by a relatively simple and inexpensive drawing technique, as contrasted to the more expensive machining process used to make conventional brass sleeve members.

Insulating inner sleeve members 24 and 62 are also inexpensive to provide. More particularly, such members 24 and 62 are plastic parts formed by a relatively inexpensive conventional molding process. Such insulating inner sleeve members 24 and 62 provide mechanical strength to sleeve member assemblies 14 and 60, respectively, and also provide mating portions 28 and 68, respectively, for mating to complimentary mating portion 22 of tip contact member 12. Moreover, the plastic of insulating inner sleeve members 24 and 62 can be readily dyed to provide an effective and inexpensive color coding scheme.

Having described preferred embodiments of the invention, it will now become apparent to one of skill in the art that other embodiments incorporating their concepts may be used. It is felt, therefore, that these embodiments should not be limited to disclosed embodiments, but rather should be limited by the spirit and scope of the appended claims.

What is claimed is:

1. An electrical jack plug comprising:

a tip contact member having a first end with a tapered tip component adapted for coupling to a jack receptacle, a second end with a conductor contact member, and a first mating portion disposed axially between said first and second ends; and a sleeve member assembly disposed over said second end, said assembly comprising:

an insulating inner sleeve member comprising means, including a second mating portion mated with the first mating portion of the tip contact member, for disengaging the first mating portion from the second mating portion;

a conductive outer sleeve member coupled to and substantially surrounding said inner sleeve member.

2. The electrical jack plug recited in claim 1 wherein the sleeve member assembly has an end disposed proximal to said tapered tip component and an end disposed distal from said tapered tip component and wherein the insulating inner sleeve member has an annular portion protruding beyond said outer sleeve member at said distal end.

3. The electrical jack plug recited in claim 1 wherein a portion of said insulating inner sleeve member has an outer diameter greater than the inner diameter of said conductive outer sleeve member so that the insulating inner sleeve member is confined within said conductive outer sleeve member.

4. The electrical jack plug recited in claim 1 wherein the sleeve member assembly has an end disposed proximal to said tapered tip component and an end disposed distal from said tapered tip component and wherein the insulating inner sleeve member has an annular portion protruding beyond said conductive outer sleeve member at said proximal end.

5. The electrical jack plug recited in claim 4 wherein said annular portion is larger in diameter than said conductive outer sleeve member.

6. A method for providing an insulating jack plug comprising the steps of:

providing a tip contact member having a first end with a tapered tip component adapted for coupling to a jack receptacle, a second end with a conductor contact member, and a mating portion disposed axially between said first and second ends;

providing a sleeve member assembly having an insulating inner sleeve member with a mating portion and a conductive outer sleeve member;

mating said mating portion of said tip contact member with said mating portion of said insulating inner sleeve member so that the mating portion of said tip contact member is disengageable from the mating portion of the insulating inner sleeve member.

7. The method for providing an insulating jack plug recited in claim 6 wherein the step of providing the sleeve member assembly includes the step of press fitting the insulating inner sleeve member into the conductive outer sleeve member.

8. The method for providing an insulating jack plug recited in claim 6 further comprising the step of drawing a metal disc to provide said conductive outer sleeve member.

9. The method for providing an insulating jack plug recited in claim 6 further comprising the step of molding plastic to form said insulating inner sleeve member.

10. The method for providing an insulating jack plug recited in claim 9 further comprising the step of dying said plastic to a desired color.

* * * * *